US008127414B2

(12) United States Patent
Rankin

(10) Patent No.: US 8,127,414 B2
(45) Date of Patent: Mar. 6, 2012

(54) CASKET HAVING EXCHANGEABLE INNER SHELL AND ASSOCIATED METHODS

(76) Inventor: Martha Elizabeth Rankin, Menifee, CA (US)

( * ) Notice: Subject to any disclaimer, the term of this patent is extended or adjusted under 35 U.S.C. 154(b) by 127 days.

(21) Appl. No.: 12/714,453

(22) Filed: Feb. 27, 2010

(65) Prior Publication Data

US 2010/0218351 A1 Sep. 2, 2010

Related U.S. Application Data

(60) Provisional application No. 61/208,795, filed on Feb. 28, 2009.

(51) Int. Cl.
*A61G 17/00* (2006.01)

(52) U.S. Cl. ..... 27/35; 27/27

(58) Field of Classification Search ..... 27/35, 27, 27/33, 19, 4, 2; 220/23.87, 23.89; 414/529
See application file for complete search history.

(56) References Cited

U.S. PATENT DOCUMENTS 3,133,334 A * 5/1964 Johnsen ..... 27/27
3,613,189 A * 10/1971 Kirby ..... 27/35
3,654,676 A * 4/1972 McHugh ..... 27/2
3,810,282 A 5/1974 Doggett
4,063,337 A * 12/1977 Havey, III ..... 27/2
4,177,543 A * 12/1979 Angermann ..... 27/35
4,788,757 A * 12/1988 Bethune et al. ..... 27/2
5,481,785 A * 1/1996 Minton et al. ..... 27/27
5,956,825 A * 9/1999 McCoy et al. ..... 27/2
6,317,943 B1 * 11/2001 Wood ..... 27/4
6,385,824 B1 * 5/2002 Schwartz ..... 27/35
6,684,467 B1 2/2004 Walker
7,204,003 B2 * 4/2007 Davis et al. ..... 27/2
7,302,743 B2 * 12/2007 Fash ..... 27/4
7,350,278 B2 4/2008 Davis et al.

* cited by examiner

*Primary Examiner* — William L. Miller
(74) *Attorney, Agent, or Firm* — Mark R. Malek, Esq.; Zies Widerman & Malek

(57) ABSTRACT

A casket according to the present invention may include an outer shell comprising a base, a pair of opposing sidewalls extending upwardly from the base, a pair of opposing endwalls extending upwardly from the base and connected to the pair of opposing sidewalls, a lid connected to the pair of opposing sidewalls and adapted to be moved between an opened position and a closed position, and a plurality of rollers carried by the base. At least one of the opposing sidewalls or opposing endwalls is adapted to be moved between an opened position and a closed position. The casket may also include an inner shell comprising a tray, a lid member adapted to overlie the tray member, and a fastener member carried by the lid member and including a pair of opposing end portions adapted to engage a portion of the tray member and adapted to engage one another to fasten the lid member to the tray member.

30 Claims, 4 Drawing Sheets

CASKET HAVING EXCHANGEABLE INNER SHELL AND ASSOCIATED METHODS

RELATED APPLICATIONS

This application claims the benefit of U.S. Provisional Patent Application Ser. No. 61/208,795 titled Riklaym casket with exchangeable liners filed on Feb. 28, 2009, by the inventor of the present application, the entire contents of which are incorporated herein by reference.

FIELD OF THE INVENTION

The present invention relates to the field of burial caskets and, more specifically to the field of caskets having exchangeable inner shells and associated methods.

BACKGROUND OF THE INVENTION

Benjamin Franklin once wrote, "in this world nothing can be said to be certain, except death and taxes." While that statement was written more than two hundred twenty years ago, it is still true today. Each of us will, one day, die. When we die, many of us, depending on our cultural background, religious beliefs or finances, will be displayed and/or buried in a casket.

Caskets are often the most costly component of funeral expenses, and yet caskets are nearly always only used once. Whether made of wood, metal or other material, the purchase of a one-time-use casket can cause financial hardship for those left with the task of making funeral arrangements for a deceased loved one, or can deplete the estate of a decedent that has made their own funeral arrangements in advance.

At the same time, consumers are becoming more aware of the wastefulness of one-time-use goods, and are beginning to demand that the goods they buy be made of recycled materials or at least be recyclable or reusable. While the vast majority of caskets are made out of recyclable or reusable materials, wood and/or metal, almost none of them are ever recycled or reused.

Numerous caskets have attempted to provide a low cost reusable alternative to the traditional one-time-use casket. For example, U.S. Pat. No. 3,810,282 to Doggett discloses a reusable casket with an open top, and a removable insert sized to slidably fit within the reusable casket and adapted to be slidably removed from the top of the reusable casket. The insert has a detachable lid that fits over the top of the insert after the insert has been removed from the casket. The insert lid includes vent holes at one end, and the insert includes an exhaust hole at the other end.

U.S. Pat. No. 6,684,467 to Walker discloses a reusable coffin having a casket and a vault. The casket has a headwall, a footwall, a left and a right sidewall, a first and a second lid and a bottom. The right sidewall and first and second lids have hinges. The headwall and the footwall have a latching means to secure the right sidewall. The vault fits closely within the casket to form a reusable coffin. The vault has a headwall, a footwall, a left and a right sidewall, a first and a second lid with hinges, and a bottom.

U.S. Pat. No. 7,350,278 to Davis, et. al., discloses a rental casket system including a casket with a recessed side panel for ease of viewing. The casket includes a removable end piece which in one embodiment is located within grooves formed in the side panels of the casket. The grooves widen near the upper portion of the side panels and are partially covered by the top panel. The rental casket system may further include a tray assembly that may be used as part of a cremation casket. The tray assembly has short side walls and an inner assembly that, prevents contact with a deceased when handholds in the tray assembly are used to move the tray assembly. The tray assembly includes side walls that are moveably attached to end walls. Lids are provided with the tray.

SUMMARY OF THE INVENTION

With the foregoing in mind, the present invention provides a casket that advantageously allows for the body of the deceased to be carried by an inner shell and be readily moved into and out of an outer shell of a casket. The casket according to the present invention also advantageously provides sidewalls and/or endwalls that are openable to allow for the inner shell to be moved into and out of the outer shell without the need for lifting. The casket according to the present invention further advantageously provides rollers that the inner shell may be rolled upon for ease of movement into and out of the outer shell. The casket according to the present invention additionally advantageously provides a gasketed lid for the inner shell, with an attached fastener member, to permit a secure and water-tight seal between the lid and the inner shell.

These and other objects, features and advantages according to the present invention are provided by a casket comprising an outer shell and an inner shell. The outer shell may include a base, a pair of opposing sidewalls extending upwardly from the base, and a pair of opposing endwalls extending upwardly from the base. The pair of opposing endwalls may be connected to the pair of opposing sidewalls. The outer shell may also include at least one lid connected to the pair of opposing sidewalls and adapted to be moved between an opened position and a closed position. The outer shell may further include a plurality of rollers carried by the base. At least one of the opposing sidewalls or opposing endwalls of the outer shell may be adapted to be moved between an opened position and a closed position.

The inner shell may include a tray member including a base and a pair of opposing raised ridges extending outwardly from end portions of a bottom surface of the base. The inner shell may also include a pair of opposing sidewalls extending upwardly from the base and a pair of opposing endwalls extending upwardly from the base and connected to the pair of opposing sidewalls. An optional lid member may be adapted to overlie the tray member. A fastener member may be carried by the lid member. The fastener member may include a pair of opposing end portions adapted to engage a portion of the tray member and adapted to engage one another to fasten the lid member to the tray member. The end portions of the fastener member may be passed through a handle on an outer surface of each of the opposing side walls of the tray member.

In one of the embodiments of the casket according to the present invention, at least one of the endwalls of the outer shell may be pivotally connected to one of the sidewalls so that the endwall is moveable between an opened position and a closed position. The closed position of the endwall may be defined as the endwall being in contact with both of the sidewalls, and the opened position of the endwall may be defined as the endwall being in contact with only one of the sidewalls.

In another embodiment of the casket according to the present invention, at least one of the endwalls of the outer shell may be pivotally connected to the base so that the endwall is moveable between an opened position and a closed position. The closed position of the endwall may be defined as the endwall being in contact with both of the sidewalls, and the opened position of the endwall may be defined as the endwall not being in contact with either one of the sidewalls.

In yet another embodiment of the casket according to the present invention, at least one of the endwalls of the outer shell may be pivotally connected to both of the sidewalls at a point on each of the respective sidewalls adjacent the base so that the endwall is moveable between an opened position and a closed position. The opened position of the endwall may be defined as the endwall being in contact with the respective sidewalls only at a point of pivotal connection, and the closed position of the endwall may be defined as the endwall being in contact with the respective sidewalls substantially along an entire vertical height thereof.

In still another embodiment of the casket according to the present invention, at least one of the endwalls of the outer shell may be pivotally connected to both of the sidewalls at an upper end portion of each of the respective sidewalls so that the endwall is moveable between an opened position and a closed position. The opened position of the endwall may be defined as the endwall being in contact with the respective sidewalls only at a point of pivotal connection, and the closed position of the endwall may be defined as the endwall being in contact with the respective sidewalls substantially along an entire vertical height thereof.

In another embodiment of the casket according to the present invention, at least one of the sidewalls of the outer shell may be pivotally connected to the base so that the sidewall is moveable between an opened position and a closed position. The closed position of the sidewall may be defined as the sidewall being in contact with both of the endwalls, and the opened position of the sidewall may be defined as the sidewall not being in contact with either one of the endwalls.

In yet another embodiment of the casket according to the present invention, at least one of the sidewalls of the outer shell may be pivotally connected to both of the endwalls at a point on each of the respective endwalls adjacent the base so that the sidewall is moveable between an opened position and a closed position. The opened position of the sidewall may be defined as the sidewall being in contact with the respective endwalls only at a point of pivotal connection, and the closed position of the sidewall may be defined as the sidewall being in contact with the respective endwalls substantially along an entire vertical height thereof.

In still another embodiment of the casket according to the present invention, at least one of the sidewalls of the outer shell may be pivotally connected to both of the endwalls at an upper end portion of each of the respective endwalls so that the sidewall is moveable between an opened position and a closed position. The opened position of the sidewall may be defined as the sidewall being in contact with the respective endwalls only at a point of pivotal connection, and the closed position of the sidewall may be defined as the sidewall being in contact with the respective endwalls substantially along an entire vertical height thereof.

The lid member of the inner shell may include a top surface and a bottom surface. The lid member may have a groove formed in the bottom surface substantially along an entire perimeter portion thereof. The groove may be adapted to permit entry of a top edge of the sidewalls and the endwalls of the tray member. A gasket member may be provided within the groove. The plurality of rollers may be arranged to be parallel with each of the pair of opposing endwalls of the outer shell, or may be arranged to be parallel with each of the pair of opposing sidewalls of the outer shell.

A method aspect of the present invention is for using a casket. The method may include opening at least one of the opposing sidewalls or opposing endwalls of the outer shell of the casket. The method may also include moving the inner shell between an engaged position with the outer shell and a disengaged position with the outer shell so that the inner shell is adapted to slide over the rollers. The engaged position may be defined as the inner shell being carried within an interior portion of the outer shell, and the disengaged position may be defined as the inner shell being positioned exterior to the outer shell. The method may further include closing a respective at least one of the opposing sidewalls or opposing endwalls.

DETAILED DESCRIPTION OF THE PREFERRED EMBODIMENT

Figure 1:
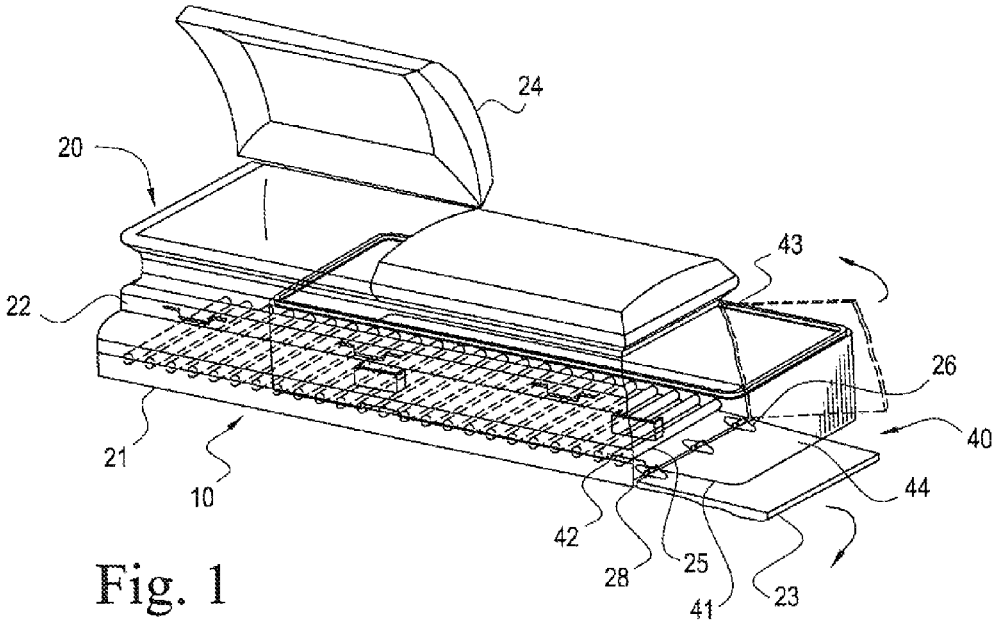
FIG. 1 is a perspective view of a casket having an exchangeable inner shell according to the present invention and showing one endwall in two alternate opened positions.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Referring now to FIGS. 1-7, details of a casket 10 according to the present invention are now described in greater detail. The unique design of the casket 10 includes an outer shell 20 and an inner shell 40.

Individual portions of the casket 10 according to the present invention will now be discussed in greater detail. Referring initially to FIGS. 1-4, the outer shell 20 of the casket 10 according to the present invention is illustrated. The outer shell 20 of the casket 10 may include a base 21, a pair of opposing sidewalls 22 extending upwardly from the base and a pair of opposing endwalls 23 connected to the sidewalls and extending upwardly from the base.

Figure 2:
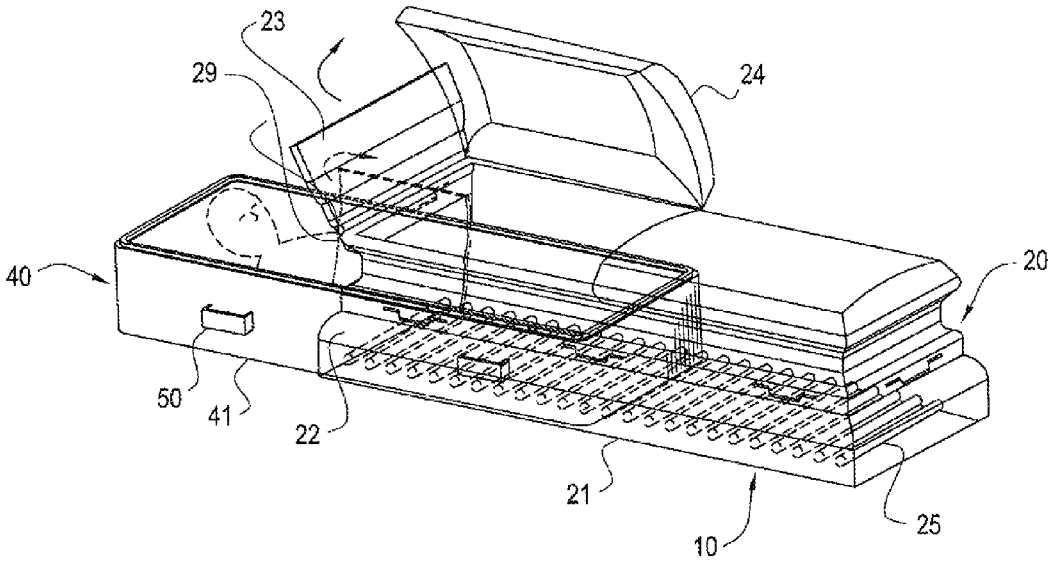
FIG. 2 is a perspective view of a casket according to the present invention and showing one endwall in two alternate opened positions.

The outer shell 20 may include at least one lid 24 connected to at least one of the pair of opposing sidewalls 22. The lid 24 may be adapted to be moved between an opened position and a closed position. As illustrated in FIGS. 1 and 2, the lid 24 may include an upper lid 24*a* and a lower lid 24*b*. The upper lid 24*a* may be moved between the opened and the closed positions independent of the lower lid 24*b*. This arrangement is particularly advantageous when the casket 10 according to the present invention is used for viewing of the deceased and it may, for example, be desirous to only display an upper portion of the deceased. The skilled artisan, after having had the benefit of reading this disclosure, will appreciate that the lid 24 may, for example be a one-piece lid, allowing for full viewing of the deceased, if so desired.

As illustrated in FIGS. 1-4, the outer shell 20 may include a plurality of rollers 25 carried by the base 21. The plurality of rollers 25 may illustratively be arranged parallel to the endwalls 23 of the outer shell 20, as illustrated, for example, in FIGS. 1 and 2, or may be arranged parallel to the sidewalls 22 of the outer shell, as illustrated, for example, in FIGS. 3 and 4. The plurality of rollers 25 advantageously allow for the inner shell 40 to be readily moved between an engaged position with the outer shell 20 and a disengaged position with the outer shell. Referring, more specifically, to FIG. 1, the inner shell 40 of the casket 10 according to the present invention is illustratively shown in the engaged, or partially engaged, position. The engaged, or partially engaged position, may be defined as some portion of the inner shell 40 being positioned within an interior portion of the outer shell 20. The disengaged position may be defined as the inner shell 40 being positioned completely exterior to the outer shell 20.

Figure 3:
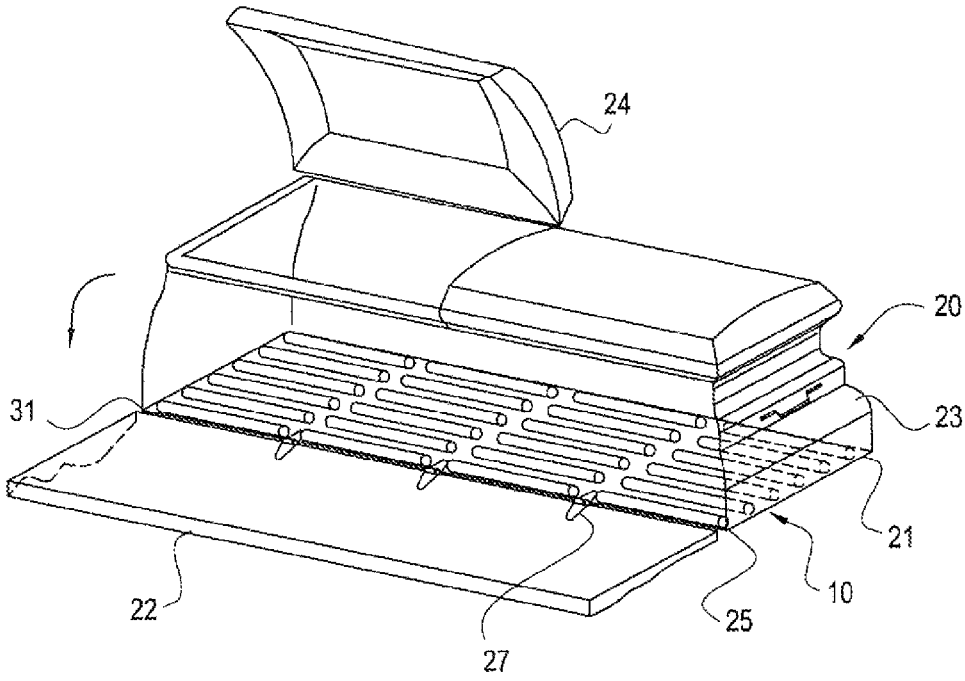
FIG. 3 is a perspective view of an outer shell of a casket according to the present invention showing one sidewall in an opened position.
Figure 4:
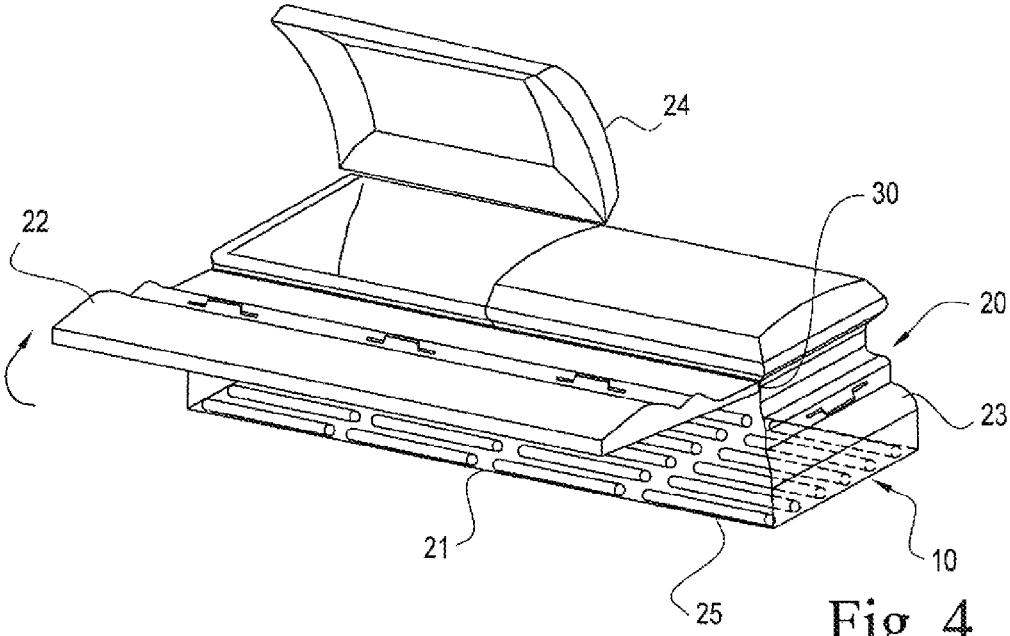
FIG. 4 is a perspective view of the outer shell of a casket according to the present invention showing one sidewall in an alternate opened position.

The rollers 25 illustrated in FIGS. 1-4 are elongate rollers. One column of rollers 25 are provided in the embodiment of the casket 10 illustrated in FIGS. 1 and 2. The rollers 25 illustrated in FIGS. 3 and 4 are also elongate rollers. Four columns of rollers 25 are provided in the embodiment of the casket 10 illustrated in FIGS. 3 and 4. Those skilled in the art, after having had the benefit of this disclosure, will appreciate that any number of columns of rollers 25 may be provided while still carrying out the goals, features and advantages according to the present invention. The present invention also contemplates that the rollers 25 may, for example, be provided by a plurality of spherical members arranged to be carried by the base 21 of the outer shell 20. The spherical members may, for example, be similar to a plurality of ball bearings. Those skilled in the art, after having had the benefit of reviewing this disclosure, will appreciate that any arrangement of spherical rollers may be provided while still carrying out the goals, features and advantages according to the present invention.

As perhaps best illustrated in FIGS. 1 and 2, at least one of the pair of opposing endwalls 23 may be adapted to be moved between an opened position and a closed position. The outer shell 20 may include a pivotal connection 26 between the at least one endwall 23 and the base 21. After having had the benefit of reading this disclosure, those skilled in the art will appreciate that the pivotal connection 26, while depicted in FIG. 1 as pivotally connecting the at least one endwall 23 to the base 21, may be positioned to pivotally connect the at least one endwall 23 to one of the sidewalls 22, to a point 28 on each of the pair of sidewalls 22 adjacent the base 21, or to a point 29 on each of the pair of sidewalls 22 at an upper end thereof, while still accomplishing the goals, features and objectives according to the present invention. The plurality of rollers 25 may be oriented to be parallel with the endwalls 23.

The pivotal connection 26 between the endwall 23 and the base 21 may, for example, be provided by a plurality of hinges. Three hinges are illustrated as providing the pivotal connection 26 between the endwall 23 and the base 21 in FIG. 1. After having had the benefit of reading this disclosure, those skilled in the art, however, will appreciate that any number of hinges may be provided for the pivotal connection 26. Although the pivotal connection 26 is illustrated in FIG. 1 as having a portion that connects the base 21 of the outer shell 20 to a lower portion of the endwall 23, as described above, the pivotal connection can be made as necessary to provide an endwall that is moveable between the opened and closed positions in several different ways.

For example, and as illustrated in FIG. 1, the endwall 23 may be pivotally connected to the base 21 of the outer shell 20 so that the endwall swings downwardly. The closed position of the endwall 23 may be defined as the endwall 23 being in contact with both of the sidewalls 22, and the opened position of the endwall 23 may be defined as the endwall 23 not being in contact with either one of the sidewalls. In such a case, hinges of the pivotal connection 26 may include a portion connected to the base 21 of the outer shell 20 and another portion connected to the lower portion of the endwall 23.

The endwall 23 may also be adapted to open and close in a side swinging arrangement. The closed position of the endwall 23 may be defined as the endwall 23 being in contact with both of the sidewalls 22, and the opened position of the endwall 23 may be defined as the endwall 23 being in contact with only one of the sidewalls 22. In such an arrangement, the pivotal connection 26 may include a portion connected to the sidewall 22 of the outer shell 20 and a portion connected to the endwall 23. Those skilled in the art will appreciate, after having had the benefit of this disclosure, that more than one pivotal connection 26 may be provided, but any number of pivotal connections are contemplated by the present invention.

By way of further example, and as illustrated in FIG. 2, the endwall 23 may be pivotally connected to a point 29 on each of the pair of sidewalls 22 at an upper end thereof so that the endwall may swing upwardly. The opened position of the endwall 23 may be defined as the endwall 23 being in contact with the respective sidewalls 22 only at a point of pivotal connection 29, and the closed position of the endwall 23 may be defined as the endwall 23 being in contact with the respective sidewalls 22 substantially along an entire vertical height thereof. In such a case, hinges of the pivotal contact 26 may include a portion connected to a point 29 on each of the pair of sidewalls 22 at an upper end thereof and another portion connected to the upper portion of the endwall 23.

The pivotal connection 26 between the endwall 23 and a point 29 on each of the pair of sidewalls 22 may, for example, be provided by a plurality of hinges. After having had the benefit of reading this disclosure, those skilled in the art will appreciate that any number of hinges may be provided for the pivotal connection 26. Although the pivotal connection 26 is described as having a portion that connects the endwall 23 of the outer shell 20 to an upper end of each of the sidewalls 22, as described above, the pivotal connection can be made as necessary to provide an endwall that is moveable between the opened and closed positions in several different ways.

As perhaps best illustrated in FIGS. 3 and 4, at least one of the pair of opposing sidewalls 22 may be adapted to be moved between an opened position and a closed position. The outer shell 20 may include a pivotal connection 27 between the at least one sidewall 22 and the base 21. After having had the benefit of reading this disclosure, those skilled in the art will appreciate that the pivotal connection 27, while depicted in FIG. 3 as pivotally connecting the at least one sidewall 22 to the base 21, may be positioned to pivotally connect the at least one sidewall 22 to a point 30 on each of the pair of endwalls 23 adjacent the base 21, or to a point 31 on each of the pair of endwalls 23 at an upper end thereof, while still accomplishing the goals, features and objectives according to the present invention. The plurality of rollers 25 may be oriented to be parallel with the sidewalls 22.

For example, and as illustrated in FIG. 3, the sidewall 22 may be pivotally connected to the base 21 of the outer shell 20 so that the sidewall swings downwardly. The closed position of the sidewall 22 may be defined as the sidewall 22 being in contact with both of the endwalls 23, and the opened position of the sidewall 22 may be defined as the sidewall 22 not being in contact with either one of the endwalls 23. In such a case, hinges of the pivotal connection 26 may include a portion connected to the base 21 of the outer shell 20 and another portion connected to a lower portion of the sidewall 22.

The pivotal connection 26 between the sidewall 22 and the base 21 may, for example, be provided by a plurality of hinges. Three hinges are illustrated as providing the pivotal connection 26 between the sidewall 23 and the base 21 in FIG. 3. After having had the benefit of reading this disclosure, those skilled in the art, however, will appreciate that any number of hinges may be provided for the pivotal connection 26. Although the pivotal connection 26 is illustrated in FIG. 3 as having a portion that connects the base 21 of the outer shell 20 to a lower portion of the sidewall 22, as described above, the pivotal connection can be made as necessary to provide a sidewall that is moveable between the opened and closed positions in several different ways.

By way of further example, and as illustrated in FIG. 4, the sidewall 22 may be pivotally connected to a point 30 on each of the pair of endwalls 23 at an upper end thereof so that the sidewall swings upwardly. The opened position of the sidewall 22 may be defined as the sidewall 22 being in contact with the respective endwalls 23 only at a point of pivotal connection 30, and the closed position of the sidewall 22 may be defined as the sidewall 22 being in contact with the respective endwalls 23 substantially along an entire vertical height thereof. In such a case, hinges of the pivotal connection 26 may include a portion connected to a point 30 on each of the pair of endwalls 22 at an upper end thereof and another portion connected to an upper portion of the sidewall 22.

The pivotal connection 26 between the sidewall 22 and a point 30 on each of the pair of endwalls 23 may, for example, be provided by a plurality of hinges. After having had the benefit of reading this disclosure, those skilled in the art will appreciate that any number of hinges may be provided for the pivotal connection 26. Although the pivotal connection 26 is described as having a portion that connects the sidewall 22 of the outer shell 20 to an upper end of each of the endwalls 22, as described above, the pivotal connection can be made as necessary to provide a sidewall that is moveable between the opened and closed positions in several different ways.

After having had the benefit of reading this disclosure, those skilled in the art will appreciate that an exterior surface of the base 21, the pair of opposing sidewalls 22, the pair of opposing endwalls 23 and the at least one lid 24 may be wood, metal or any other appealing material while still accomplishing the goals, features and objectives according to the present invention. After having had the benefit of reading this disclosure, those skilled in the art will appreciate that the exterior surface of the base 21, the pair of opposing sidewalls 22, the pair of opposing endwalls 23 and the at least one lid 24 may be finished in any appealing style, color, shape or fashion while still accomplishing the goals, features and objectives according to the present invention.

Figure 5:
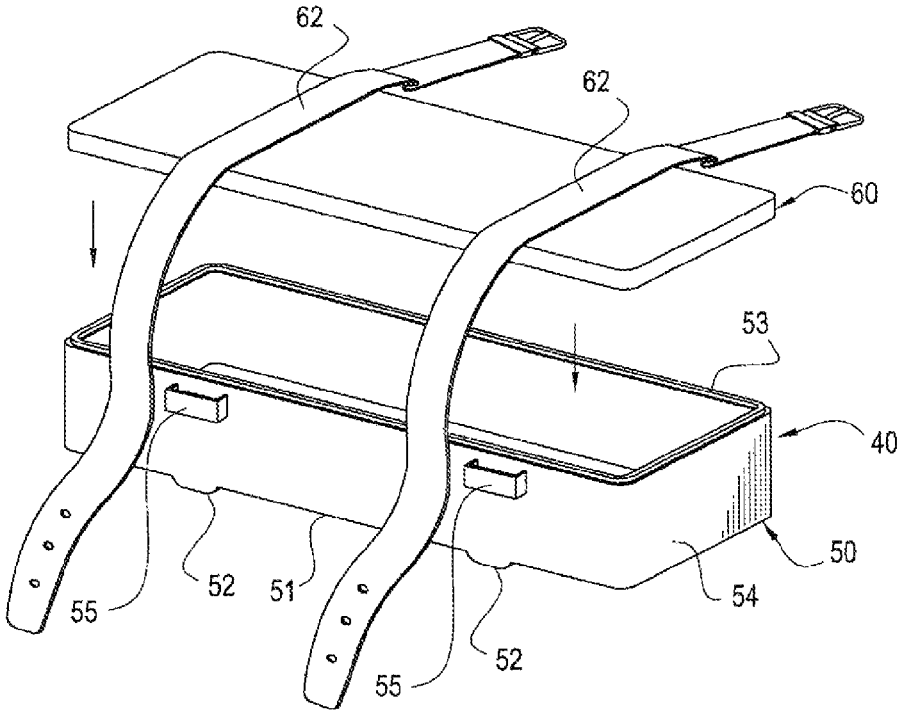
FIG. 5 is an exploded perspective view of an inner shell of a casket according to the present invention showing a lid member positioned over a tray member.
Figure 6:
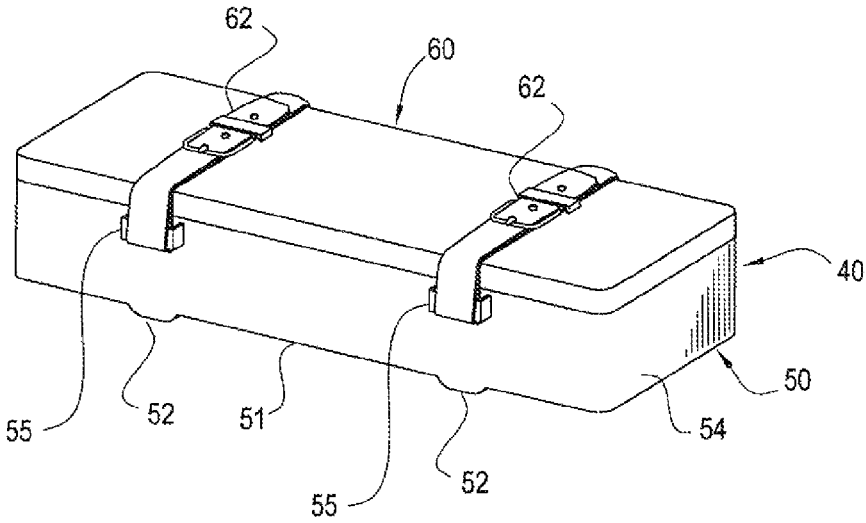
FIG. 6 is a perspective view of the inner shell illustrated in FIG. 5 showing the lid member overlying the tray member and secured in place.
Figure 7:
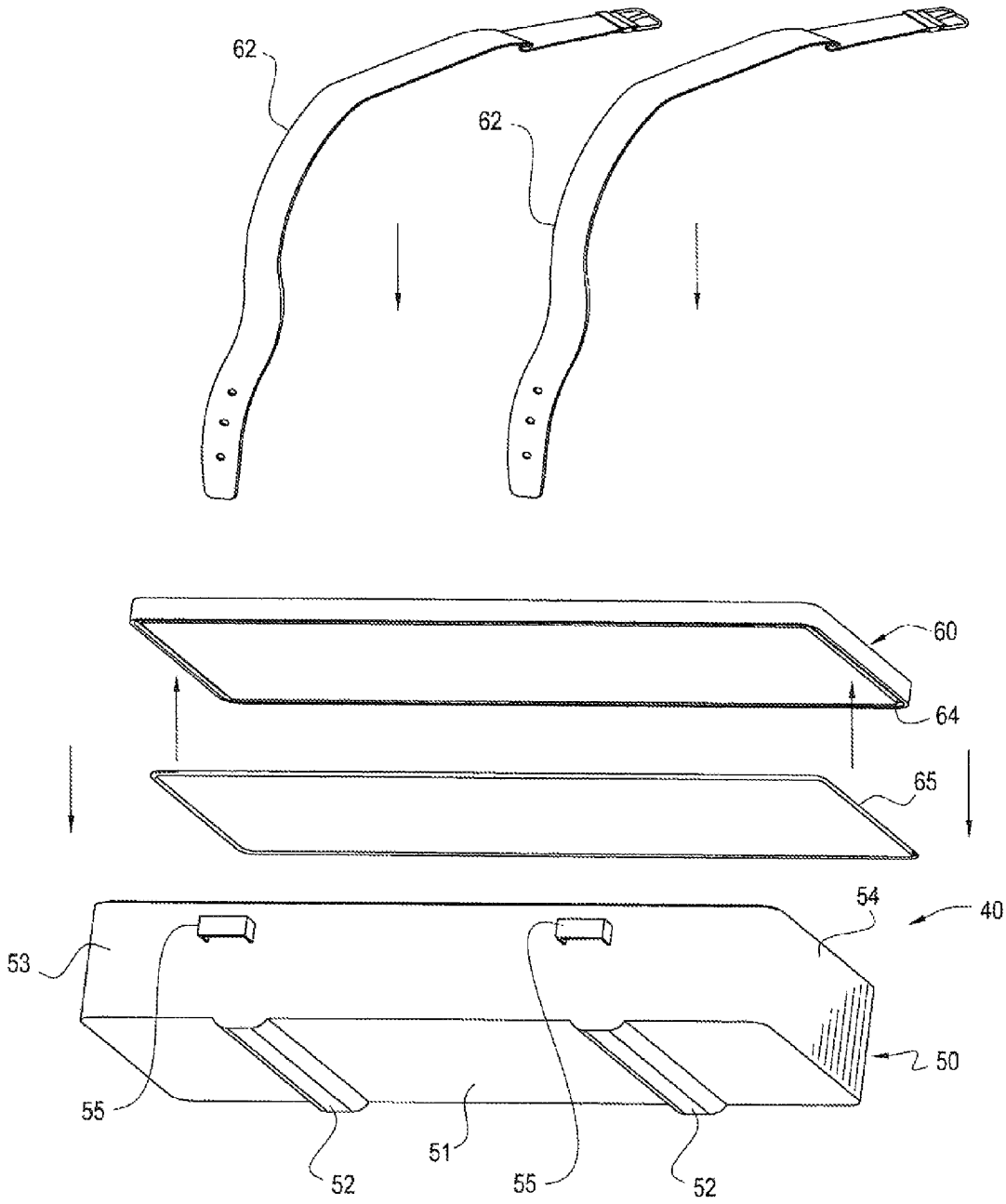
FIG. 7 is an exploded view of the lid member of the inner shell illustrated in FIG. 5 showing the lid member positioned over the tray member.

Referring now to FIGS. 5-7, the inner shell 40 of the reusable casket with removable inner shell 10 according to the present invention is illustrated. The inner shell 40 of the reusable casket with removable inner shell 10 may include a tray member 50 and a lid member 60. The tray member 50 may include a base 51 with a pair of opposing raised ridges 52 extending outwardly from either end of a bottom surface 56 of the base 51. The opposing raised ridges 52 may be positioned so that when the inner shell 40 is positioned within a grave using, for example, straps, a space may be provided between the earth and the base 51 so that the straps can be removed after the inner shell 40 has been lowered into the grave. The tray member 50 may include a pair of opposing sidewalls 53 extending upwardly from the base 51 and a pair of opposing endwalls 54 connected to the sidewalls 53 and extending upwardly from the base 51. The tray member 50 may include at least one handle 55 on an outer surface 57 of each of the sidewalls 53. The inner shell 40 illustrated in FIGS. 5 and 6 show a pair of handles 55 positioned adjacent either end of the tray member 50. Any number of handles 55 can be provided while still accomplishing the goals, features and advantages according to the present invention.

The inner shell 40 may include a lid member 60 adapted to overlie the tray member 50. At least one fastener member 62 may be carried by the lid member 60. The fastener member 62 may include a pair of opposing end portions adapted to engage a portion of the tray member 50 and adapted to engage one another to fasten the lid member 60 to the tray member. More specifically, and as perhaps best illustrated in FIG. 6, the opposing end portions of the fastener member 62 may engage the handles 55 on the tray member 50, and loop around to engage one another so that the fastener member causes the lid member 60 to be secured to the tray member.

After having had the benefit of reading this disclosure, those skilled in the art will appreciate that the fastener member 62, while depicted in FIGS. 5-7 as a strap having a tang buckle, may be a strap having a ratcheting buckle, a strap having a clip buckle, a strap with the opposite portions of a clasp buckle on either end, a strap having end portions including hook and loop fasteners, or any other type of fastener able to secure two ends of a strap together, while still accomplishing the goals, features and objectives according to the present invention. Furthermore, those skilled in the art will appreciate that the fastener member 62 may be looped through the respective at least one handle 55 on each of the sidewalls 53, may be looped around the base 51, or may otherwise be used to fasten the lid member 60 and the tray member 50 while accomplishing the goals, features, and advantages according to the present invention.

As perhaps best illustrated in FIG. 7, the lid member 60 may include a groove 64 in a bottom surface 66 thereof. The lid member 60 may include a gasket 65 positioned within the groove 64. After having had the benefit of reading this disclosure, those skilled in the art will appreciate that the tray member 50 and the lid member 60 may be polyethylene, polyurethane or any other appealing material while still accomplishing the goals, features and objectives according to the present invention.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A casket comprising:

an outer shell comprising a base, a pair of opposing sidewalls extending upwardly from the base, a pair of opposing endwalls extending upwardly from the base and connected to the pair of opposing sidewalls, at least one lid connected to at least one of the pair of opposing sidewalls and adapted to be moved between an opened position and a closed position, and a plurality of rollers carried by the base, wherein at least one of the opposing sidewalls or opposing endwalls is adapted to be moved between an opened position and a closed position, and an inner shell comprising a tray member including a base, a pair of opposing ridges extending downwardly from a bottom surface of the base and adapted to space the bottom surface of the base from the earth to allow for burial strap removal during interment, the ridges allowing the bottom surface of the base to slidably cooperate with the plurality of rollers for removable placement of the inner shell in the outer shell, a pair of opposing sidewalls extending upwardly from the base and a pair of opposing endwalls extending upwardly from the base and connected to the pair of opposing sidewalls, a lid member adapted to overlie the tray member, at least one fastener member including a pair of opposing end portions, the at least one fastener member adapted to engage a portion of the lid member and a portion of the tray member, the pair of opposing end portions of the at least one fastener member adapted to engage one another to fasten the lid member to the tray member.

2. A casket according to claim 1 wherein at least one of the endwalls of the outer shell is pivotally connected to one of the sidewalls so that the endwall is moveable between the opened position and the closed position; wherein the closed position of the endwall is defined as the endwall being in contact with both of the sidewalls; and wherein the opened position of the endwall is defined as the endwall being in contact with only one of the sidewalls.

3. A casket according to claim 1 wherein at least one of the endwalls of the outer shell is pivotally connected to the base so that the endwall is moveable between the opened position and the closed position; wherein the closed position of the endwall is defined as the endwall being in contact with both of the sidewalls; and wherein the opened position of the endwall is defined as the endwall not being in contact with either one of the sidewalls.

4. A casket according to claim 1 wherein at least one of the endwalls of the outer shell is pivotally connected to both of the sidewalls at a point on each of the respective sidewalls adjacent the base so that the endwall is moveable between the opened position and the closed position; wherein the opened position of the endwall is defined as the endwall being in contact with the respective sidewalls only at a point of pivotal connection; and wherein the closed position of the endwall is defined as the endwall being in contact with the respective sidewalls substantially along an entire vertical height thereof.

5. A casket according to claim 1 wherein at least one of the endwalls of the outer shell is pivotally connected to both of the sidewalls at an upper end portion of each of the respective sidewalls so that the endwall is moveable between the opened position and the closed position; wherein the opened position of the endwall is defined as the endwall being in contact with the respective sidewalls only at a point of pivotal connection; and wherein the closed position of the endwall is defined as the endwall being in contact with the respective sidewalls substantially along an entire vertical height thereof.

6. A casket according to claim 1 wherein at least one of the sidewalls of the outer shell is pivotally connected to the base so that the sidewall is moveable between the opened position and the closed position; wherein the closed position of the sidewall is defined as the sidewall being in contact with both of the endwalls; and wherein the opened position of the sidewall is defined as the sidewall not being in contact with either one of the endwalls.

7. A casket according to claim 1 wherein at least one of the sidewalls of the outer shell is pivotally connected to both of the endwalls at a point on each of the respective endwalls adjacent the base so that the sidewall is moveable between the opened position and the closed position; wherein the opened position of the sidewall is defined as the sidewall being in contact with the respective endwalls only at a point of pivotal connection; and wherein the closed position of the sidewall is defined as the sidewall being in contact with the respective endwalls substantially along an entire vertical height thereof.

8. A casket according to claim 1 wherein at least one of the sidewalls of the outer shell is pivotally connected to both of the endwalls at an upper end portion of each of the respective endwalls so that the sidewall is moveable between the opened position and the closed position; wherein the opened position of the sidewall is defined as the sidewall being in contact with the respective endwalls only at a point of pivotal connection; and wherein the closed position of the sidewall is defined as the sidewall being in contact with the respective endwalls substantially along an entire vertical height thereof.

9. A casket according to claim 1 wherein the lid member of the inner shell includes a top surface and a bottom surface, a groove in the bottom surface of the lid member substantially along an entire perimeter portion thereof and adapted to permit entry of a top edge of the pair of opposing sidewalls and the pair of opposing endwalls of the tray member, and a gasket member within the groove.

10. A casket according to claim 1 wherein the plurality of rollers are arranged to be parallel with each of the pair of opposing endwalls of the outer shell.

11. A casket according to claim 1 wherein the plurality of rollers are arranged to be parallel with each of the pair of opposing sidewalls of the outer shell.

12. A casket according to claim 1 wherein each of the opposing sidewalls of the tray member includes an inner surface and an outer surface and at least one handle on the outer surface of each of the sidewalls.

13. A casket comprising:

an outer shell comprising a base, a pair of opposing sidewalls extending upwardly from the base, a pair of opposing endwalls extending upwardly from the base and connected to the pair of opposing sidewalls, at least one lid connected to at least one of the pair of opposing sidewalls and adapted to be moved between an opened position and a closed position, and a plurality of rollers carried by the base, the rollers being positioned parallel to at least one of the pair of opposing sidewalls and the pair of opposing endwalls, wherein at least one of the opposing sidewalls or opposing endwalls is adapted to be moved between an opened position and a closed position, and an inner shell comprising a tray member including a base, a pair of opposing ridges extending downwardly from a bottom surface of the base and adapted to space the bottom surface of the base from the earth to allow for burial strap removal during interment, the ridges allowing the bottom surface of the base to slidably cooperate with the plurality of rollers for removable placement of the inner shell in the outer shell, a pair of opposing sidewalls extending upwardly from the base and a pair of opposing endwalls extending upwardly from the base and connected to the pair of opposing sidewalls.

14. A casket according to claim 13 wherein at least one of the endwalls of the outer shell is pivotally connected to one of the sidewalls so that the endwall is moveable between the opened position and the closed position; wherein the closed position of the endwall is defined as the endwall being in contact with both of the sidewalls; and wherein the opened position of the endwall is defined as the endwall being in contact with only one of the sidewalls.

15. A casket according to claim 13 wherein at least one of the endwalls of the outer shell is pivotally connected to the base so that the endwall is moveable between the opened position and the closed position; wherein the closed position of the endwall is defined as the endwall being in contact with both of the sidewalls; and wherein the opened position of the endwall is defined as the endwall not being in contact with either one of the sidewalls.

16. A casket according to claim 13 wherein at least one of the endwalls of the outer shell is pivotally connected to both of the sidewalls at a point on each of the respective sidewalls adjacent the base so that the endwall is moveable between the opened position and the closed position; wherein the opened position of the endwall is defined as the endwall being in contact with the respective sidewalls only at a point of pivotal connection; and wherein the closed position of the endwall is defined as the endwall being in contact with the respective sidewalls substantially along an entire vertical height thereof.

17. A casket according to claim 13 wherein at least one of the endwalls of the outer shell is pivotally connected to both of the sidewalls at an upper end portion of each of the respective sidewalls so that the endwall is moveable between the opened position and the closed position; wherein the opened position of the endwall is defined as the endwall being in contact with the respective sidewalls only at a point of pivotal connection; and wherein the closed position of the endwall is defined as the endwall being in contact with the respective sidewalls substantially along an entire vertical height thereof.

18. A casket according to claim 13 wherein at least one of the sidewalls of the outer shell is pivotally connected to the base so that the sidewall is moveable between the opened position and the closed position; wherein the closed position of the sidewall is defined as the sidewall being in contact with both of the endwalls; and wherein the opened position of the sidewall is defined as the sidewall not being in contact with either one of the endwalls.

19. A casket according to claim 13 wherein at least one of the sidewalls of the outer shell is pivotally connected to both of the endwalls at a point on each of the respective endwalls adjacent the base so that the sidewall is moveable between the opened position and the closed position; wherein the opened position of the sidewall is defined as the sidewall being in contact with the respective endwalls only at a point of pivotal connection; and wherein the closed position of the sidewall is defined as the sidewall being in contact with the respective endwalls substantially along an entire vertical thereof.

20. A casket according to claim 13 wherein at least one of the sidewalls of the outer shell is pivotally connected to both of the endwalls at an upper end portion of each of the respective endwalls so that the sidewall is moveable between the opened position and the closed position; wherein the opened position of the sidewall is defined as the sidewall being in contact with the respective endwalls only at a point of pivotal connection; and wherein the closed position of the sidewall is defined as the sidewall being in contact with the respective endwalls substantially along an entire vertical height thereof.

21. A method for using a casket, the casket comprising an outer shell and an inner shell, the outer shell comprising a base, a pair of opposing sidewalls extending upwardly from the base, a pair of opposing endwalls extending upwardly from the base and connected to the pair of opposing sidewalls, at least one lid connected to at least one of the pair of opposing sidewalls and adapted to be moved between an opened position and a closed position and a plurality of rollers carried by the base, the plurality of rollers being aligned parallel to at least one of the pair of opposing sidewalls and the pair of opposing endwalls, the inner shell comprising a tray member including a base, a pair of opposing ridges extending downwardly from a bottom surface of the base, the ridges adapted to space the bottom surface of the base from the earth to allow for burial strap removal during interment, the ridges allowing the bottom surface of the base to slidably cooperate with the plurality of rollers for removable placement of the inner shell in the outer shell, a pair of opposing sidewalls extending upwardly from the base and a pair of opposing endwalls extending upwardly from the base and connected to the pair of opposing sidewalls, the method comprising:

opening at least one of the opposing sidewalls or opposing endwalls of the outer shell;

moving the inner shell between an engaged position with the outer shell and a disengaged position with the outer shell, the inner shell being adapted to slide over the rollers, the engaged position being defined as the inner shell being carried within an interior portion of the outer shell, and the disengaged position being defined as the inner shell being positioned exterior to the outer shell; and closing a respective at least one of the opposing sidewalls or opposing endwalls of the outer shell.

22. A method for using a casket according to claim 21 wherein at least one of the pair of opposing endwalls of the outer shell is pivotally connected to one of the pair of opposing sidewalls so that opening at least one of the pair of opposing endwalls comprises laterally swinging the at least one endwall.

23. A method for using a casket according to claim 21 wherein at least one of the pair of opposing endwalls of the outer shell is pivotally connected to the base so that opening at least one of the pair of opposing endwalls comprises vertically swinging the at least one endwall.

24. A method for using a casket according to claim 21 wherein at least one of the pair of opposing endwalls of the outer shell is pivotally connected to both of the pair of opposing sidewalls at a point on each of the pair of opposing sidewalls adjacent the base so that opening at least one of the pair of opposing endwalls comprises vertically swinging the at least one endwall.

25. A method for using a casket according to claim 21 wherein at least one of the pair of opposing endwalls of the outer shell is pivotally connected to both of the pair of opposing sidewalls at an upper end of each of the pair of opposing sidewalls so that opening at least one of the pair of opposing endwalls comprises vertically swinging the at least one endwall.

26. A method for using a casket according to claim 21 wherein at least one of the pair of opposing sidewalls of the outer shell is pivotally connected to the base so that opening at least one of the pair of opposing sidewalls comprises vertically swinging the at least one sidewall.

27. A method for using a casket according to claim 21 wherein at least one of the pair of opposing sidewalls of the outer shell is pivotally connected to both of the pair of opposing endwalls at a point on each of the pair of opposing endwalls adjacent the base so that opening at least one of the pair of opposing sidewalls comprises vertically swinging the at least one sidewall.

28. A method for using a casket according to claim 21 wherein at least one of the pair of opposing sidewalls of the outer shell is pivotally connected to both of the pair of opposing endwalls at an upper end of each of the pair of opposing endwalls so that opening at least one of the pair of opposing sidewalls comprises vertically swinging the at least one sidewall.

29. A method for using a casket according to claim 21, wherein the inner shell further comprises a lid member adapted to overlie the tray member, at least one fastener member including a pair of opposing end portions, the at least one fastener member adapted to engage a portion of the lid member and a portion of the tray member, the pair of opposing end portions of the at least one fastener member adapted to engage one another to fasten the lid member to the tray member, and wherein the method further comprises placing the lid member on the tray member and engaging the opposing end portions of the fastener member to one another.

30. A method for using a casket according to claim 21, wherein the inner shell further comprises a lid member adapted to overlie the tray member, at least one fastener member including a pair of opposing end portions, the at least one fastener member adapted to engage a portion of the lid member and a portion of the tray member, the pair of opposing end portions of the at least one fastener member adapted to engage one another to fasten the lid member to the tray member, at least one handle on an outer surface of each of the opposing sidewalls of the tray member and wherein the method further comprises placing the lid member on the tray member, passing at least one of the end portions of the fastener member through the at least one handle on the opposing sidewalls of the tray member and engaging the end portions of the fastener member to one another.

* * * * *